US005876244A

United States Patent [19]

Tabata

[11] Patent Number: 5,876,244

[45] Date of Patent: Mar. 2, 1999

[54] CONNECTOR COVER

[75] Inventor: Masaaki Tabata, Yokkaichi, Japan

[73] Assignee: Sumitomo Wiring Systems, Ltd., Japan

[21] Appl. No.: 893,262

[22] Filed: Jul. 15, 1997

[30] Foreign Application Priority Data

Jul. 15, 1996 [JP] Japan ..... 8-185009

[51] Int. Cl.[6] ..... H01R 13/52

[52] U.S. Cl. ..... 439/521; 439/352

[58] Field of Search ..... 439/135, 521, 439/352, 358, 372, 718

[56] References Cited

U.S. PATENT DOCUMENTS 4,681,383 7/1987 Hung et al. .
5,382,176 1/1995 Norden .
5,564,944 10/1996 Fukuda ..... 439/521
5,571,030 11/1996 Gladd et al. .

FOREIGN PATENT DOCUMENTS 3-17426 4/1991 Japan .

OTHER PUBLICATIONS

Abstract of Japanese Application No. 62–206131, Aug. 19, 1987 (Publication No. 01049712, Feb. 27, 1989).

*Primary Examiner*—Khiem Nguyen
*Attorney, Agent, or Firm*—Banner & Witcoff, Ltd.

[57] ABSTRACT

A connector cover 30 attached to the posterior end of a female connector 10 is made of hard synthetic resin so that, for example, it can withstand the shock of high-pressure water used to wash cars, and flying stones. The upper portion of this cover 30 comprises a protecting arch 33 which is deformable to release a locking arm 16 of the connector 10. Internal rubber seals water-proof the connector.

10 Claims, 5 Drawing Sheets

CONNECTOR COVER

TECHNICAL FIELD

The present invention relates to a connector cover for protecting a connector provided with a locking arm.

BACKGROUND TO THE INVENTION

Conventional connector covers made of rubber permit operation of a locking arm through the cover itself. Such a connector cover is shown in FIG. 7 of this specification. An upper face of a connector 1 has a locking arm 2 provided thereon, and a corresponding connector (not shown) fits therewith. The locking arm maintains the two connectors in a latched state. In the case where the connector 1 is used, for example, in the wiring for an engine compartment of an automobile or under a wheel arch, a connector cover 3 is attached in order to protect the connector 1 from flying stones when the automobile is in motion.

The connector cover 3 is shaped like a boot so as to surround the entire connector 1, including a locking arm. Since it is desirable that the locking arm be operable with the connector cover fitted, the connector cover 3 is made of rubber and therefore is soft. As a result, when a portion A is pressed against the locking arm 2, the arm is released and the connectors can be separated.

In addition to protection against flying stones, it has also recently become necessary to provide protection against high pressure water, for example from vehicle washers. Unfortunately a rubber boot does not provide sufficient protection against water under high pressure. Accordingly, instead of rubber, it was proposed that synthetic resin be used to produce a connector cover. However, although protection against water under pressure is good, the degree of hardness is so high that operating the locking arm through the connector cover is almost impossible.

The present invention has been developed after taking the above problem into account, and aims at providing a connector cover that can both protect against flying stones and high pressure water, yet allow easy operation of the locking arm.

SUMMARY OF THE INVENTION

According to the invention there is provided a cover for a connector having an external locking arm releasable by inward movement of a release portion thereof, the cover being attachable to the connector and covering said release portion in use, wherein said cover is of a relatively rigid plastics material and includes a deformable portion overlying said release portion and movable inwardly against said release portion to release said locking arm. Such a cover provides protection against water jets and flying stones, yet is adapted to release the locking arm without separating the cover and connector.

Preferably the cover comprises a composite moulding, said deformable portion being of substantially less rigid material than the remainder of said cover. Such a composite moulding can be formed by insert moulding or any other suitable technique.

In the alternative the cover may comprise an integral moulding of rigid plastics material, said deformable portion being attached to the remainder of said cover by a weakened area so as to be movable relative thereto. The arch portion of the cover may be weakened by thinning, to operate the locking arm, or may include a small aperture through which a release tool may be inserted. In one embodiment a tool may be inserted between the arch and the release member to depress the release member by levering.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
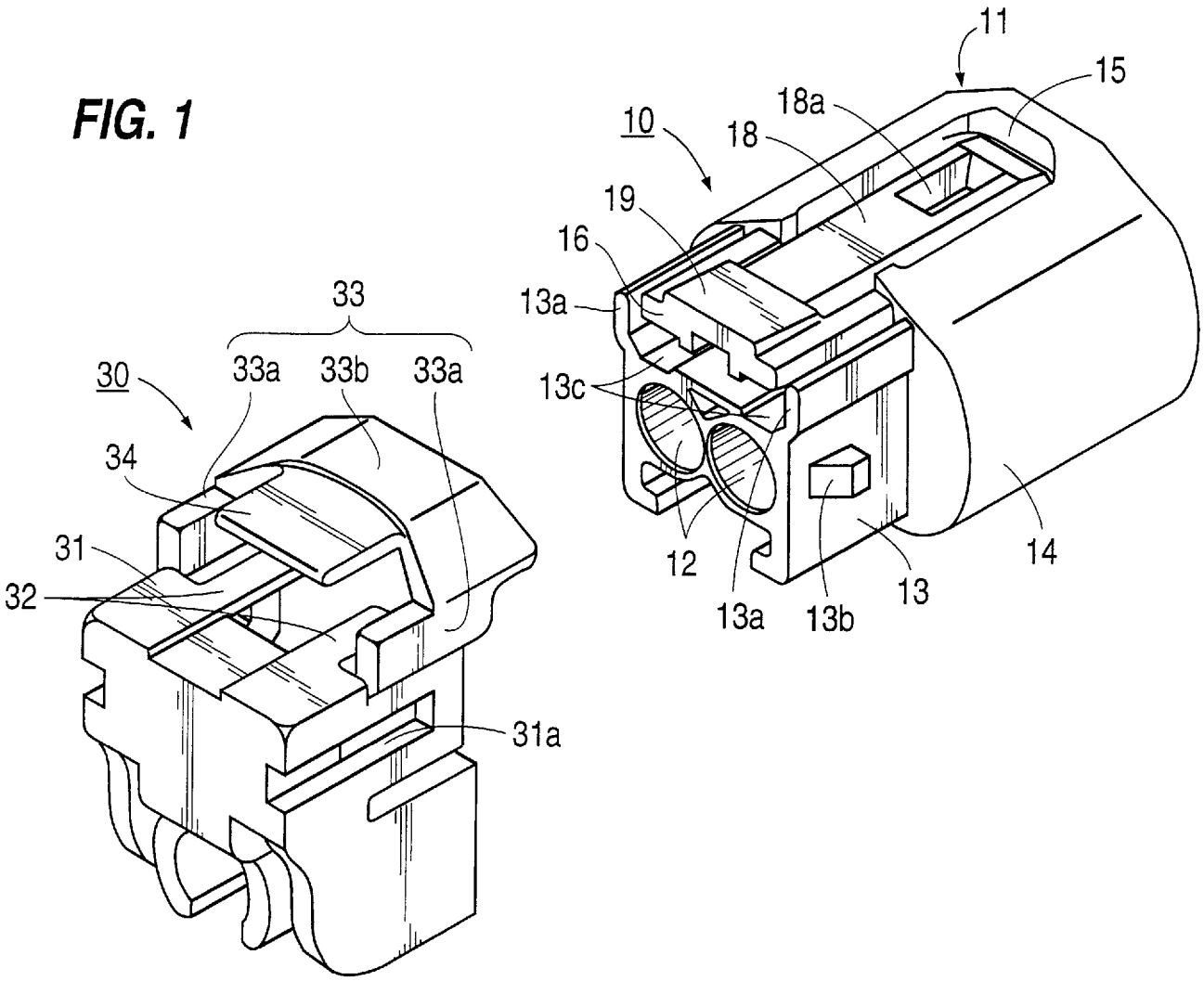
FIG. 1 is a diagonal view showing a female connector and a connector cover of a first embodiment.

A first embodiment of the present invention is explained hereinbelow, with reference to FIGS. 1 to 4.

A female connector 10 is used, for example, in the wiring of an engine compartment of an automobile or under a wheel arch, and a connector cover 30 relating to the present invention is attached for protection in situations such as when water under high pressure is applied during washing, or when a stone hits the connector 10 when the automobile is moving.

The female connector 10 comprises a connector housing 11, made of hard synthetic resin, with a main body 13 which has two cavities 12 and a surrounding hood member 14. A corresponding connector (not shown) fits in the hood member 14, in use.

Figure 3:
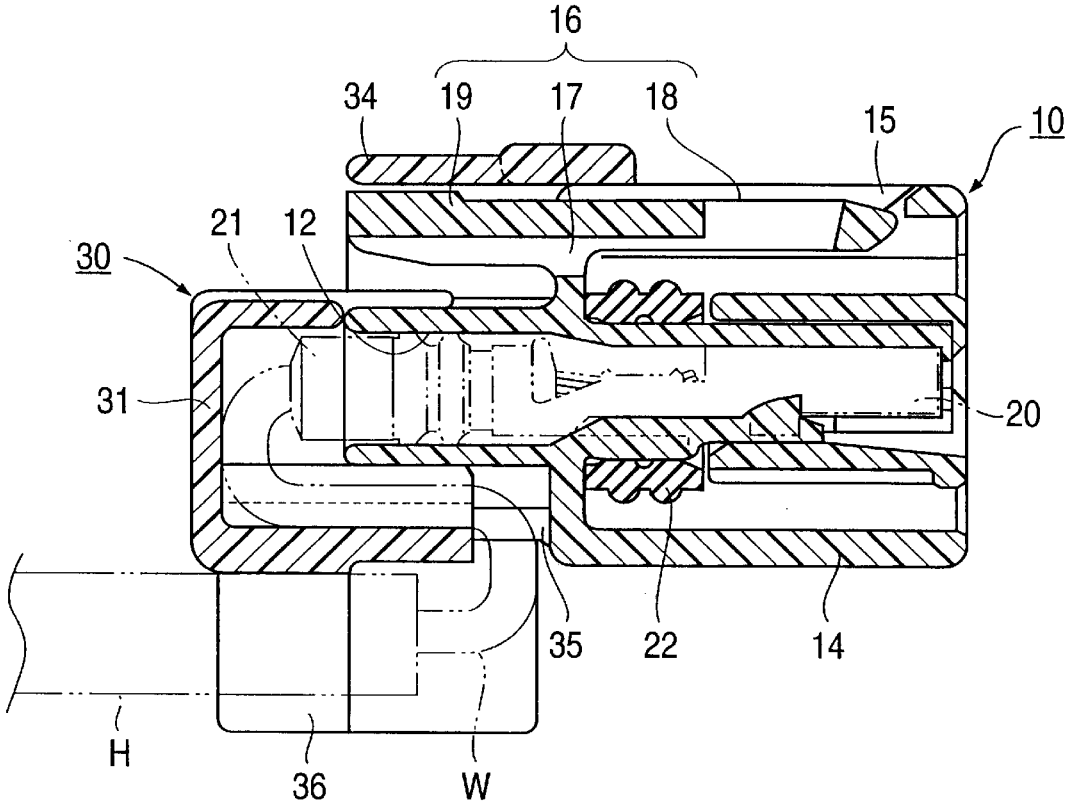
FIG. 3 is a cross-sectional view through the first embodiment.

The hood member 14 has a cut away concave recess 15 formed so as to extend from the posterior end of the upper end to the anterior end, a locking arm 16 being provided in the recess 15. As shown in FIG. 3, the locking arm 16 has a see-saw shape and its rotation supporting member 17 is located at the posterior end of the hood member 14. A latching arm 18, located anteriorly with respect to the rotation supporting member 17, protrudes into the hood member 14 via the recess 15, a latching hole 18*a* formed on the arm 18 being arranged to fit with a protrusion (not shown) of a corresponding connector when inserted into the hood member 14. The posterior side of the supporting member 17 constitutes an operating member 19 and extends up to the posterior end of the connector housing 11. When this operating member 19 is pressed, the latching arm 18 rises up and the fitting with the protrusion of the corresponding connector is released, allowing the connectors to be separated.

Further, as shown in FIG. 1, on both sides of the hood member 14, the two sides of the upper face of the main body 13 having rising edge members 13*a*, these edge members 13*a* shielding both sides of the operating member 19.

Insertion holes of the cavities 12 open out from the posterior end face of the main body 13. As shown in FIG. 3, the cavities 12 have terminals 20 housed therein, each terminal 20 having an electric wire W crimped thereon. The wire W extends out from the insertion hole and the terminal 20 has a rubber grommet 21 fixed thereon in order to water-proof the insertion hole.

A water-proof ring 22 is provided in order to effect water-proofing at the fitting face with the corresponding connector (not shown). Due to the rubber grommet 21 and the water-proof ring 22, the cavities 12 form a sealed water-proof space.

The posterior end of the female connector 10 has a connector cover 30 made of hard synthetic resin attached from the posterior side in order to protect the female connector 10 from high-pressure water or flying stones. The connector cover 30 has a box-shaped main body 31 that opens out in the anterior direction (the direction facing the posterior end face of the female connector 10), the posterior end of the connector housing 11 being attached by being inserted into this main body 31. Retention grooves 31*a* are formed on both sides faces of the main body 31, for engagement with protrusions 13*b* formed on the side faces of the main body 13. The protrusions 13*b* are capable of being released, and fix the connector cover 30 as a whole in place (see FIG. 2).

The upper face of the main body 31 has a pair of members 32 formed so as to protrude in an anterior direction. These are inserted into the grooves 13*c* formed on the two side faces of the upper face on the posterior end of the connector housing 11. Accordingly, the connector cover 30 can be smoothly attached to the female connector 10. An upper protecting arch member 33 shields the locking arm 16 as illustrated.

Figure 2:
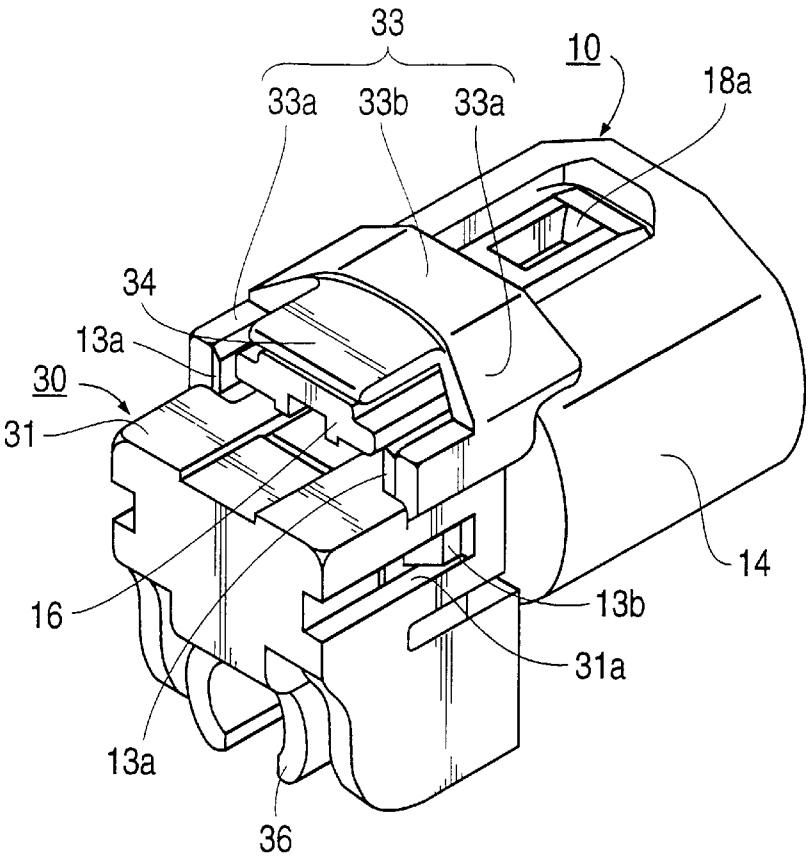
FIG. 2 is a diagonal view showing a state whereby the connector cover is attached to the female connector.

The anterior side of this arch 33*b* protrudes towards the anterior with respect to the side wall face 33*a*, and, as shown in FIG. 2, protects the rotation supporting member 17 of the locking arm 16 from above. Furthermore, the arch 33*b* corresponds approximately to the external circumferential shape of the upper face of the hood member 14, and rises up diagonally from the side wall faces 33*a*, and towards its central portion it becomes horizontal and comes to correspond to the locking arm 16.

The arch 33*b* described above has an easily bendable protecting arm member 34 which extends horizontally in a posterior direction and is positioned so as to be located above the operating member 19, a small space being formed therebetween. This supporting arm member 34, made of malleable synthetic resin (for example, elastomers of nylon, polypropylene etc.), is formed in a unified manner with the connector cover 30 (made of, for example, polybutylene terephthalate), and serves to protect the locking arm 16 from flying stones, but bends easily when pushed, thereby allowing the operating member 19 of the locking arm 16 to be pushed down. In other words, the locking arm 16 can be operated whilst keeping the connector cover 30 attached to the female connector 10.

As shown in FIG. 3, when the connector cover 30 is attached to the female connector 10, the electric wire W bends within the main body 31 in a U-shape and folds over in the anterior direction, extending outwards from an electric wire exit hole 35 provided on the lower face of the anterior edge of the main body 31.

An electric wire clip 36 hangs downwards (as viewed) from the lower face of the main body 31, posteriorly with respect to the electric wire exit hole 35. This electric wire clip 36 serves to guide in a posterior direction the electric wire W coming out from the electric wire exit hole 35. Furthermore, the electric wire W protruding outwards from the electric wire exit hole 35 has a covering tube H attached thereon from outside so as to protect it. One end of the covering tube H fits into the electric wire clip 36.

Next, the operation of the present embodiment is described. The open end of the main body 31 of the connector cover 30 is pushed on to the connector 10. When this is done, as shown in FIG. 2, the retention grooves 31*a* and the protrusions 13*b* fit with each other, resulting in the connector cover 30 being retained. When this state is reached, the external portion of the electric wire W is protected by the main body 31, and the rotation supporting member 17 and the operating member 19 are shielded from above by the arched member 33 and the arm protecting member 34.

The rubber grommet 21 that water-proofs the insertion hole of the cavity 12 is covered from the exterior by the connector cover 30. Accordingly, even if high-pressure water for washing is pointed at the posterior side of the female connector 10, it cannot directly strike the grommet 21, so that there is no reduction in the water-proofing ability of the grommet. Furthermore, since the connector cover 30 is made of hard synthetic resin, there is no possibility of its changing shape or of being damaged due to the high-pressure water. Consequently, the automobile can be washed without worrying about the high-pressure water entering or releasing the connector.

Further, since the rotation supporting member 17 and the operating member 19 of the locking arm 16 are covered from above, there is no possibility of a flying stone directly striking the locking arm 16 and causing damage or an accidental release of the lock. The posterior end face of the female connector 10 is protected by means of the main body 31, and furthermore, since the electric wire W has a covering tube H, these are also protected from flying stones. Further, although the upper part of the locking member 18 is exposed, it is supported by the corresponding connector from the lower side thereof and accordingly the likelihood of damage due to a stone striking it is small.

Separation of the female connector 10 from the corresponding connector is carried out as described below.

In the attached state of the connector cover 20 with the female connector 10, the arm protecting member 34 is pressed down. Since the arm protecting member 34 is made of malleable synthetic resin, it can easily be bent and the operating member 19 of the locking arm 16 pushed down, the lock being released and the female connector 10 being separated from the corresponding connector. Furthermore, there is no possibility of the arm protecting member 34 getting bent due to stones of the size that would strike against it.

In this way, since, except for the arm protecting member 34, the connector cover 30 is made entirely of hard synthetic resin, its capability for protecting is much greater than a cover of rubber. Accordingly, it can withstand the shock of high-pressure water and of flying stones etc. Moreover, operability is also good since the locking arm 16 can be operated without separating the cover 30 from the female connector 10.

Figure 4:
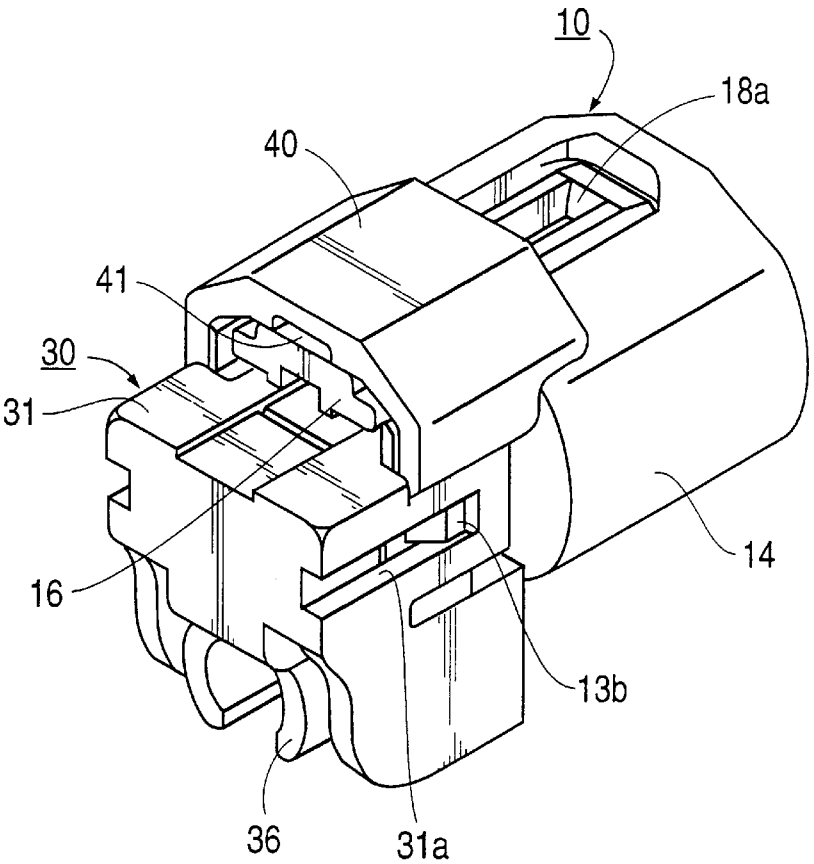
FIG. 4 is a diagonal view showing a female connector and a connector cover of a second embodiment.
Figure 5:
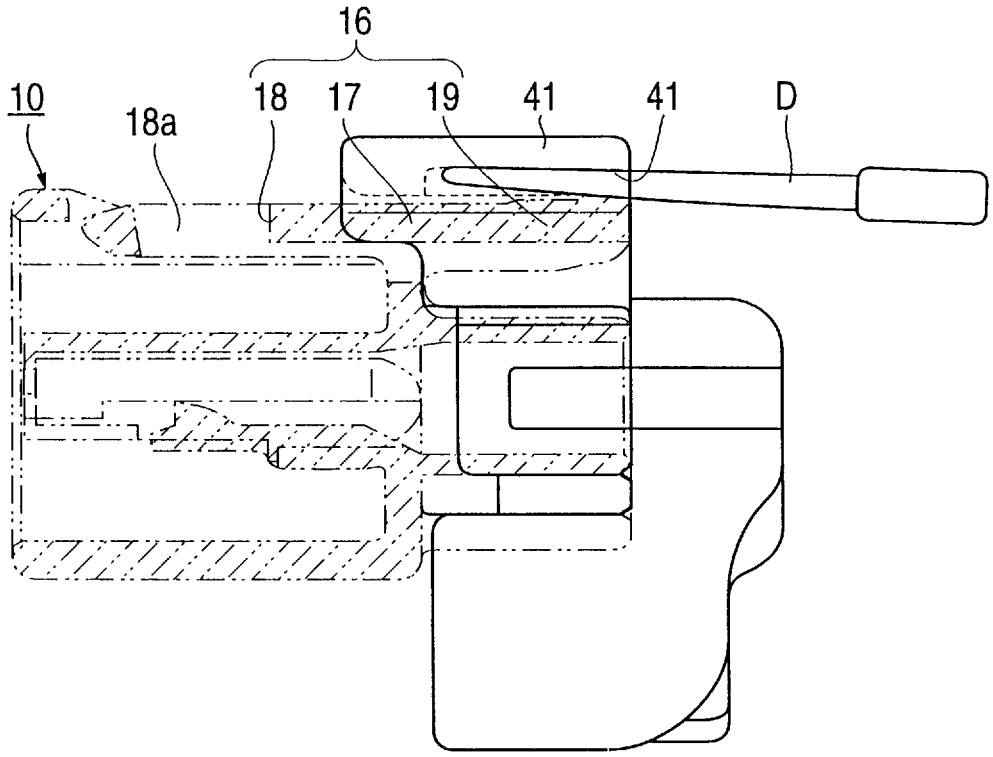
FIG. 5 is a cross-sectional view through the second embodiment.
Figure 7:
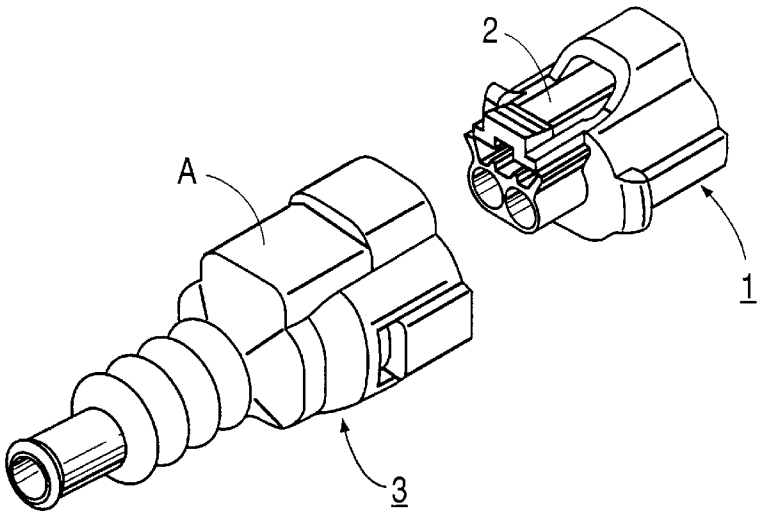
FIG. 7 PRIOR ART
FIG. 7 is a diagonal view of a prior art connector and cover.

Next, a second embodiment of the present invention is a presented below with reference to FIGS. 4 and 5.

Regarding the configuration of parts that are the same as the first embodiment, the same numbers are accorded thereto, and an explanation is omitted of the structure, operation and effects thereof.

An upper protecting wall 40 provided on the upper face of a connector cover 30 is formed so as to cover the upper face by extending from the posterior side of a main body 13 to the posterior side of a hood member 14. The ceiling face of the upper protecting wall 40 has a tool insertion groove 41 provided at a location facing an operating member 19 of a locking arm 16, this tool insertion groove 41 allowing the insertion of a tool. One end of this tool insertion groove 41 opens out towards the posterior end of the connector cover 30, and from this opening a tool (for example, a flat screwdriver indicated by D in FIG. 5) can be inserted and inclined, thereby pushing the operating member 18 of the locking arm 16 downwards. Consequently, the locking arm 16 can be operated and the fitting with the corresponding connector released while keeping the connector cover 30 in an attached state. In the first embodiment, only the arm protecting member 34 within the upper protecting wall 33 was made of malleable resin material, but in the present embodiment, the connector as a whole is uniformly formed from hard resin material.

Furthermore, both ends of the groove are located in the vicinity of the rotation supporting member 17 of the locking arm 16 and have inner walls to prevent an excessively deep insertion of the tool.

The present invention is not limited to the embodiments described above with the aid of figures. For example, the possibilities described below also lie within the technical range of the present invention. Moreover, the present invention may be modified without departing from the scope of the appended claims.

(1) In the first embodiment, although a case was described where the easily bending member is formed by means of malleable resin material, the following are also possible alternatives:

(a) It may be equally arranged that the arm protecting member is also made of hard resin material and its root portion is provided with a hinge, allowing the hinge to bend towards the centre.

(b) It may be equally arranged that the arm protecting member is made in a unified manner of hard resin material, as in the case of (a) above, but the arch member 33*b* is made thinner than other portions so as to allow the pushing operation to be carried out through the arch member 33*b*.

Figure 6:
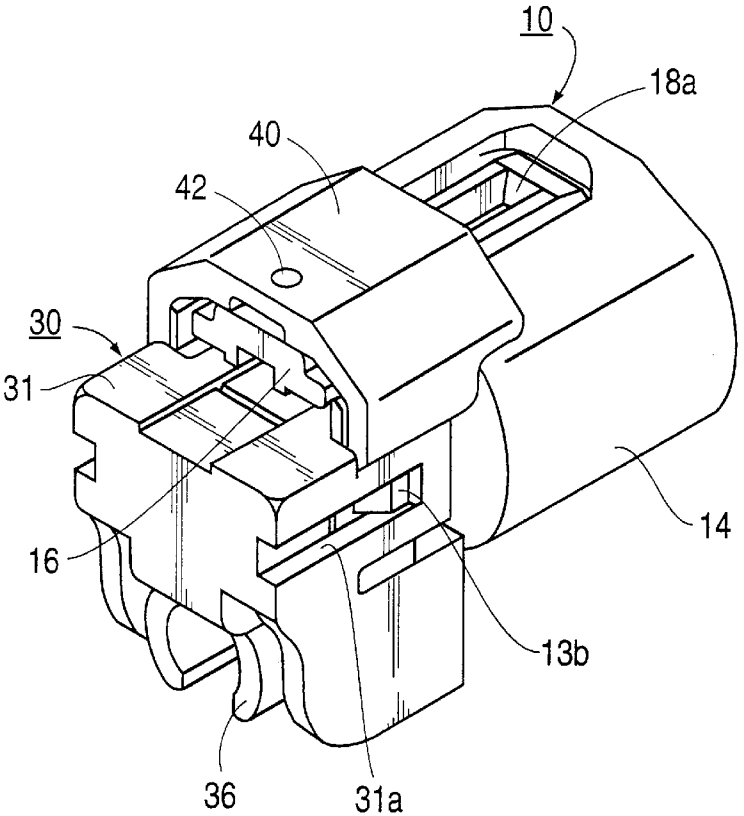
FIG. 6 is a diagonal view showing a female connector and a connector cover of a third embodiment.

(2) Although in the second embodiment, the tool insertion groove 41 permits the release of the lock of the locking arm 16 by two operations whereby it first allows the insertion of a tool (for example, a screwdriver or the like) between the upper protecting wall 40 and the locking arm 16, and then allowing the locking arm 16 to be pushed down, for example, as shown in FIG. 6, it may be equally arranged so that a through hole 42 is provided on the portion facing the operating member 19 of the locking arm 16. This allows the release of the locking arm 16 by means of the single operation of inserting the screwdriver or the like into the through hole 42 to directly push the locking arm downwards.

I claim:

1. A cover for a connector having a terminal with a wire which extends from a rear aperture of the connector and an external locking arm releasable by inward movement of a release portion thereof, the cover comprising:

a body composed of a relatively rigid material and including side walls, a rear wall and an arch in fixed relation to one another to define a forwardly opening cavity for receiving and attaching to the connector, said rear wall being adapted to cover the rear aperture of the connector, and said arch being adapted to overlie an outer side portion of the connector; and a depressible member coupled to said arch to overlie said release portion of said locking arm, said depressible member being movable inwardly relative to the rigid arch in use against said release portion to release said locking arm and disconnect the connector without removing the cover from the connector, said arch extending outward relative to said depressible member for protection against inadvertent disconnection of the connector.

2. A cover according to claim 1 wherein said cover comprises a composite moulding, and said depressible member is composed of a substantially less rigid material than the body and arch of said cover.

3. A cover according to claim 1 wherein said body and said depressible member are formed as an integral moulding of rigid plastics material, said depressible member being attached to the remainder of said cover by a weakened area so as to be movable relative thereto.

4. A cover according to claim 1 wherein said body and said depressible member are formed as an integral moulding of rigid plastics material, said depressible member being sufficiently thin so as to be deformable thereby to release said locking arm.

5. A cover and a connector in combination, the connector having a rear aperture, a terminal with a wire extending from the rear aperture of the connector and an external locking arm for latching with a mating connector, the locking arm being releasable by depression thereof, and the cover being composed of a rigid plastic material and including side walls, a rear wall and an arch in fixed relation to one another to define a forwardly opening cavity for receiving and attaching to the connector, said rear wall covering the rear aperture of the connector, and said arch covering said locking arm, said arch and said locking arm having a clearance therebetween adapted to receive a levering tool whereby the locking arm can be depressed by levering against said arch.

6. A cover and a connector in combination:

said connector having a rear aperture, a terminal with a wire extending from the rear aperture of the connector, and an external locking arm releasable by inward movement of a release portion thereof;

said cover having a body and a depressible member, said body being composed of a relatively rigid material, and including side walls, a rear wall and an arch in fixed relation to one another to define a forwardly opening cavity for receiving and attaching to the connector, said rear wall covering the rear aperture of the connector, and said arch overlying an outer side portion of the connector, and said depressible member being coupled to said arch to overlie said locking arm, said depressible member being movable inwardly relative to the rigid arch in use against said locking arm to release said locking arm and disconnect the connector without removing the cover from the connector, said arch extending outward relative to said depressible member for protection against inadvertent disconnection of the connector.

7. A cover and connector according to claim 6 wherein said cover comprises a composite moulding, and said depressible member is composed of a substantially less rigid material than the body and arch of said cover.

8. A cover and connector according to claim 6 wherein said body and said depressible member are formed as an integral moulding of rigid plastics material, said depressible member being attached to the remainder of said cover by a weakened area so as to be movable relative thereto.

9. A cover and connector according to claim 6 wherein said body and said depressible member are formed as an integral moulding of rigid plastics material, said depressible member being sufficiently thin so as to be deformable thereby to release said locking arm.

10. A cover for a connector having a terminal with a wire extending from a rear aperture of the connector and an external locking arm for latching with a mating connector, the locking arm being releasable by depression thereof, the cover being composed of a rigid plastic material and including side walls, a rear wall and an arch in fixed relation to one another to define a cavity for receiving and connecting to the connector, said rear wall being adapted to cover the rear aperture of the connector, and said arch being adapted to cover the locking arm, said arch having slot formed in an inner surface thereof facing the locking arm to receive a levering tool whereby the locking arm can be depressed by levering against said arch.

* * * * *